US008459377B2

(12) United States Patent
Moyes

(10) Patent No.: US 8,459,377 B2
(45) Date of Patent: Jun. 11, 2013

(54) DOWNHOLE DRIVE FORCE GENERATING TOOL

(75) Inventor: Peter Barnes Moyes, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 1239 days.

(21) Appl. No.: 11/430,364

(22) Filed: May 9, 2006

(65) Prior Publication Data

US 2007/0089911 A1 Apr. 26, 2007

(30) Foreign Application Priority Data

May 10, 2005 (GB) ..... 0509465.1

(51) Int. Cl.
*E21B 41/00* (2006.01)

(52) U.S. Cl.
USPC ..... 175/93; 166/300

(58) Field of Classification Search
USPC ..... 175/93, 107; 166/300
See application file for complete search history.

(56) References Cited

U.S. PATENT DOCUMENTS 2,621,351 A * 12/1952 Piety ..... 15/104.05
2,673,069 A 3/1954 Carpenter ..... 255/4.4
2,680,486 A * 6/1954 Carpenter ..... 166/297
2,680,487 A * 6/1954 Carpenter ..... 175/14
2,965,078 A * 12/1960 Chesnut et al. ..... 91/323
2,974,727 A * 3/1961 Goodwin ..... 166/55
3,083,779 A * 4/1963 Rowley ..... 175/107
4,051,909 A 10/1977 Baum ..... 175/93
4,202,168 A * 5/1980 Acheson et al. ..... 60/777
4,206,810 A 6/1980 Blackman
4,378,048 A * 3/1983 Madgavkar et al. ..... 166/256
4,545,430 A * 10/1985 Retallick ..... 166/59
4,930,454 A * 6/1990 Latty et al. ..... 122/4 D
5,161,616 A * 11/1992 Colla ..... 166/297
5,267,622 A * 12/1993 Fletcher et al. ..... 175/296
5,392,860 A 2/1995 Ross
5,396,951 A 3/1995 Ross
5,603,384 A * 2/1997 Bethel et al. ..... 175/4.54
6,151,961 A 11/2000 Huber et al.
6,247,536 B1 6/2001 Leismer et al.
6,491,102 B2 12/2002 Leismer et al.
6,815,946 B2 11/2004 Yoo
7,228,910 B2 6/2007 Howlett
7,363,967 B2 4/2008 Burris, II et al.
7,591,319 B2 9/2009 Xu
7,626,393 B2 12/2009 De Jesus et al.
2004/0089450 A1* 5/2004 Slade et al. ..... 166/298
2005/0239661 A1* 10/2005 Pfefferle ..... 507/100
2007/0272411 A1 11/2007 Lopez de Cardenas et al.
2008/0083536 A1* 4/2008 Cavender et al. ..... 166/302

(Continued)

OTHER PUBLICATIONS

Search Report for GB0509465.1.

(Continued)

*Primary Examiner* — Shane Bomar
(74) *Attorney, Agent, or Firm* — Cantor Colburn LLP

(57) ABSTRACT

An apparatus and method for generating a drive force in a downhole environment includes chambers of a reactant and a catalyst, respectively, that are maintained separate until selectively exposed to one another. Once exposed, the reactant and catalyst produce expanding fluid pressure and sometimes heat. The products of the reaction are directed to a drive member to carry out a desired operation in the downhole environment.

17 Claims, 6 Drawing Sheets

U.S. PATENT DOCUMENTS

| | | | | |
|---|---|---|---|---|
| 2009/0008096 | A1 * | 1/2009 | Schultz et al. | 166/303 |
| 2009/0038796 | A1 | 2/2009 | King | |
| 2009/0038802 | A1 | 2/2009 | Lucas | |
| 2010/0051264 | A1 | 3/2010 | Willauer | |
| 2010/0126716 | A1 | 5/2010 | Joseph | |

OTHER PUBLICATIONS

LRI Perforating Systems Inc., "Pressure Activated Firing Head", Tubing conveyed Perforating Products, 2006, p. 1.

Precision Combustion, Inc., "PCI Developing Downhole Catalytic Combustor Steam Generator for Heavy Oil Production", PCI in the News, www.precision-combustion.com, North Haven, CT, May 2, 2006 pp. 1-2.

Precision Combustion, Inc., "Adavanced Catalytic Reactors and Systems for the Energy Sector" Company Capabilities, www.precision-combustion.com, North Haven, CT, 2004-2008, pp. 1-8.

* cited by examiner

DOWNHOLE DRIVE FORCE GENERATING TOOL

CROSS-REFERENCE TO RELATED APPLICATIONS

This application claims priority to U.K. Patent Application No. 0509465.1, filed May 10, 2005, which is incorporated by reference in its entirety.

BACKGROUND

The present invention relates to a downhole tool for, and a method of, generating a drive force in a downhole environment. In particular, but not exclusively, the present invention relates to downhole tools for generating rotary and axial drive forces in a downhole environment.

Tools for generating a drive force in a downhole environment are known in the oil/gas industry. These include downhole motors, turbines and setting tools. Turbines are fluid driven and are run on a string of tubing, with associated fluid circulation apparatus at surface. Whilst this is an effective procedure for most drilling applications, it is time-consuming and expensive for secondary drilling applications, such as removing an obstruction in a borehole or de-scaling and hydrate removal procedures.

Setting tools are used to generate a force to set tools such as plugs, packers and the like, which are initiated by a tensile/compressive load. One known setting tool is the pyrotechnic setting tool which generates high forces by ignition/detonation of a pyrotechnic charge. The pyrotechnic charge is housed in a pressure-tight piston chamber, and detonation generates a controlled burn, releasing gases which generate significant pressure in the chamber. This pressure acts on a piston which "strokes", generating a high force, similar to a hydraulic ram, and this force is applied directly to the tool to be set. There are many disadvantages associated with pyrotechnic tools. For example, pyrotechnic charges are require delicate handling under very stringent regulations. Export/import of explosives into and out of certain regions of the world is prohibited. Use of the tool involves significant risks to personnel and structures. An electrical charge is required to ignite or detonate the charge and this limits use of the tool mainly to electric wireline applications. In such applications, radio silence must be enforced in the vicinity of the setting tool during deployment. If the setting tool is deployed on slick wireline, a battery operated trigger or detonator is required which operates on a timer basis, limiting its uses. Finally, failure of the charge to properly detonate creates a significant handling problem.

SUMMARY

According to a first aspect of the present invention, there is provided a downhole tool for generating a drive force in a downhole environment, the tool including: a chamber for storing a reactant; activating means for activating the reactant; and isolation means for isolating the activating means from the reactant, and for selectively exposing the activating means to the reactant to activate the reactant and generate a drive medium for driving a drive member to generate the drive force.

Advantageously, this provides a downhole tool which may be used to generate a drive force when required, by exposing the activating means to the reactant. The tool may therefore be located downhole before activating the reactant to generate the drive force, for carrying out a desired downhole procedure. Furthermore, the tool can be easily pulled out of hole for replenishment of the reactant or replacement of the activating means.

The downhole tool may be, for example, a setting tool; a fishing tool; a cutting tool such as a casing or tubing cutter, a mill, a drill, or a tubing/casing clean-up or de-scaling and hydrate removal tool; a wireline or coiled tubing tractor; or an artificial lift tool for driving a pump.

Preferably, at least part of the isolation means is movable to expose the activating means to the reactant. In particular, at least part of the isolation means may be moveable between at least an isolation position where a barrier is defined between the activating means and the reactant, and an exposed position, where the activating means is exposed to the reactant. The isolation means may include a movable member and may further include a seal for isolating the activating means from the reactant. The seal may be fixed relative to a body of the tool and the activating means may be coupled to the movable member for moving the activating means into the reactant chamber. Alternatively, the seal may be movable relative to the movable member and the movable member may be movable to release the seal and expose the activating means to the reactant.

Conveniently, the downhole tool is a one-shot tool for use downhole and subsequent return to surface for replenishment of the reactant and/or the activating means. Alternatively, the downhole tool may be a multi-shot tool; this may allow a number of downhole procedures to be carried out before the tool is required to be returned to surface for replenishment. It will be understood that this may be achieved by selectively isolating and exposing the activating means a number of times downhole.

Preferably, the downhole tool includes the drive member. The drive member may comprise a rotatable drive member or a member for generating an axial force such as a piston. The rotatable member may in particular comprise a turbine rotor, or a rotor of a motor, such as a positive displacement motor (PDM). Alternatively, the drive member may be separate from the downhole tool, and may form part of a secondary tool.

Preferably, the reactant comprises a chemical reactant such as an oxidising agent, in particular hydrogen peroxide ($H_2O_2$), and the activating means comprises catalyst means such as a copper, iron or other metal based catalyst. In particular, the catalyst means may comprise copper or iron sulphate. Thus when the copper/iron based catalyst is exposed to the hydrogen peroxide, the drive medium generated comprises oxygen, and water in the form of steam as the reaction is exothermic. Accordingly, the generated drive medium may comprise a fluid, in particular a gas, liquid, or vapour.

The movable part of the isolation means may be moveable in response to an applied external force, which may be generally axially directed. The movable part of the isolation means may be directly or indirectly moveable; in particular, it may be adapted to be moved relative to a body of the tool by a force exerted directly on the moveable part. Alternatively, the movable part may be adapted to be moved relative to the body by a force exerted on the tool body. The drive member itself may define the moveable part of the isolation means, and the activating means may be coupled to the drive member, such that movement of the drive member moveable exposes the activating means to the reactant. Alternatively, the moveable part of the isolation means may be moveable by application of a fluid pressure force.

The tool may be adapted to be run on, in particular, wireline or coil tubing for ease and speed of deployment. However, the tool may be adapted to be run on any suitable means such as drill or completion tubing or the like.

The downhole tool may include a vent for venting spent drive medium out of the tool. The downhole tool may further comprise a pressure relief valve for controlling the venting of spent drive medium from the downhole tool in the event of the pressure of the drive medium reaching a determined threshold value.

According to a second aspect of the present invention, there is provided a downhole tool for generating a rotary drive force, the tool having: a chamber for storing a reactant; activating means for activating the reactant; isolation means for isolating the activating means from the reactant, and for selectively exposing the activating means to the reactant to activate the reactant and generate a drive medium; and a rotatable drive member adapted to be driven by the drive medium to generate the rotary drive force.

Preferably, the downhole tool is a turbine or a motor, such as a positive displacement motor (PDM). Advantageously, the invention provides a turbine or motor, which does not require a motive fluid to be supplied from surface. Instead, the turbine/motor can be located downhole and the activating means exposed to the reactant, to generate the drive medium downhole for driving the rotatable drive member. The downhole tool may in particular comprise or form part of, for example, a setting tool; a cutting tool such as a casing/tubing cutter, a milling tool, a drilling tool, a tubing/casing clean-up or de-scaling and hydrate removal tool; a linear propulsion tool such as a wireline or coiled tubing tractor; and an artificial lift tool.

Preferably, the rotatable drive member comprises a rotor. The tool may include a tool body defining the reactant chamber. At least part of the isolation means may be moveable relative to a body of the tool to expose the activating means to the reactant. The movable part of the isolation means may comprise a support member and the activating means may be coupled to the support member for moving the activating means into the reactant chamber. The isolation means may further comprise a seal for isolating the activating means from the reactant. The seal may be located in a wall of the reactant chamber and the activating means may be moveable from an isolated position outside the chamber to an exposed position inside the chamber.

The downhole tool may include a tool connection member through which a force may be exerted on the moveable part of the isolation means, to expose the activating means to the reactant. The connection member may be coupled to the body of the tool and the may be initially restrained from movement with respect to the body until a determined release force is exerted thereon. The connection member may be initially restrained by shearable restraints, such as release screws or pins which may be adapted to shear at the determined release force.

The downhole tool may further include a fluid medium outlet for directing generated fluid medium to exit the reactant chamber to impinge on and drive the rotatable drive member. The outlet may be closed by the activating means and/or the movable support member when the activating means is isolated from the reactant and may be open when the activating means is exposed to the reactant. Thus a rotary drive force may be generated, and through a suitable coupling with a secondary tool, such as a drill bit, a desired downhole procedure may be carried out. The downhole tool may further include at least one vent for venting spent drive medium from the tool.

According to a third aspect of the present invention, there is provided a downhole tool for generating a force in a downhole environment, the tool having: a chamber for storing a reactant; activating means for activating the reactant; isolation means for isolating the activating means from the reactant, and for selectively exposing the activating means to the reactant to activate the reactant and generate a drive medium; and a piston member adapted to be driven by the drive medium to generate the force.

Preferably, the downhole tool is a setting tool or an impact hammer. However, the tool may be, for example, a fishing tool; or a cutting tool such as a tubing or casing cutter, wireline sidewall cutter, crimper or the like. The tool may be for generating an axial force and thus the piston member is preferably axially movable. The generated force may be a compressive or tensile force. In use, the downhole tool may advantageously be latched to a secondary tool such as a plug, packer, gauge hanger, anchor or any other similar device, before the activating means is exposed to the reactant. This generates the drive medium, to drive the piston member and exert a setting or jarring force on the secondary tool.

At least part of the isolation means may be moveable relative to a body of the tool to expose the activating means to the reactant. Preferably, the piston member defines the moveable part of the isolation means, and the activating means may be mounted on or in the piston member. Alternatively, the piston member may be separate from the isolation means. The piston member may be movable in a first direction to at least partly expose the activating means to the reactant. The downhole tool may include a tool connection member coupled to the body of the tool for exerting a force on the tool to relatively move the piston member in the first direction, to initiate the reaction. The piston member may also be moveable in a second direction opposite said first direction under the force of the generated drive medium acting on the piston, to generate the force. The reaction causes rapid movement of the piston relative to the tool body in said second direction, to generate a relatively large compressive or tensile force. The downhole tool may include at least first and second couplings for coupling the tool to a secondary tool, for exerting a force on the secondary tool directed between the respective couplings. The piston member may include or define one of the first and second couplings and the tool body may define the other coupling.

The isolation means may further include an activation sleeve which may be movable relative to the activating means, for selectively isolating the activating means from the reactant. The activation sleeve may be at least partly restrained against movement with the piston member in said first direction to at least partly expose the activating means to the reactant. The isolation means may also comprise a reactant release sleeve defining a primary barrier to isolate the activating means from the reactant. The release sleeve may be moveable to expose the activating means to the reactant following movement of the piston member in said first direction. The tool may further have a vent for allowing movement of the piston member in said second direction, the vent preventing hydraulic lock-up. The tool may also have a reactant filling port for reactant replenishment. The filling port may include a pressure release valve for allowing venting of spent drive medium from the chamber in the event of the tool experiencing over-pressure during the reaction. Further features of the reactant and the activating means of the second and third aspects are defined above in relation to the first aspect of the present invention.

According to a fourth aspect of the present invention, there is provided a downhole tool assembly comprising the downhole tool of any one of the first to third aspects of the present invention.

Further features of the downhole tool are defined above with reference to the first to third aspects of the invention.

According to a fifth aspect of the present invention, there is provided a method of generating a drive force in a downhole environment, the method comprising the steps of: providing a downhole tool having a reactant and activating means for activating the reactant; isolating the activating means from the reactant to initially prevent the activating means from activating the reactant; locating the tool in a downhole environment; exposing the activating means to the reactant to activate the reactant and generate a drive medium; and directing the generated drive medium to drive a drive member and generate the drive force.

The downhole tool is preferably charged with reactant at surface and the reactant is isolated from the activating means by sealing the activating means with respect to the reactant. The method may be implemented in a one-shot operation, including the step of removing the downhole tool from the downhole environment after exposure of the activating means to the reactant and optionally recharging the downhole tool with reactant for subsequent further use. Alternatively, the method may further include the step of re-isolating the activating means from the reactant in the downhole environment, to prevent further reaction. Thus the method may further be used in a multi-shot operation which may also include the step of re-exposing the activating means to the reactant, to re-activate the reactant. This may allow further downhole procedures to be carried out before the tool is removed from the downhole environment.

The activating means may be exposed to the reactant by applying an external force to the downhole tool. The activating means may be coupled to a moveable member of the tool and a force may be exerted on the moveable member to expose the activating means to the reactant. The downhole tool may be suspended from a tool connection member coupled to the moveable member, and a force may be exerted on the tool connection member and thus on the moveable member to move the activating means to expose it to the reactant. The method may further include the step of exerting a determined force on the support member to expose the activating means to the reactant, to overcome a restraining force exerted on the tool connection.

Alternatively, the method may further include the step of coupling the activating means to the drive member and moving the drive member in a first direction, to expose the activating member to the reactant, to activate the reactant. The generated drive medium may move the drive member in a second, opposite direction to generate the drive force. The drive force may be exerted on a secondary tool coupled to the downhole tool and may be a compressive or tensile load.

BRIEF DESCRIPTION OF THE FIGURES

Embodiments of the present invention will now be described, by way of example only, with reference to the accompanying drawings, in which.

DETAILED DESCRIPTION

Figure 1:
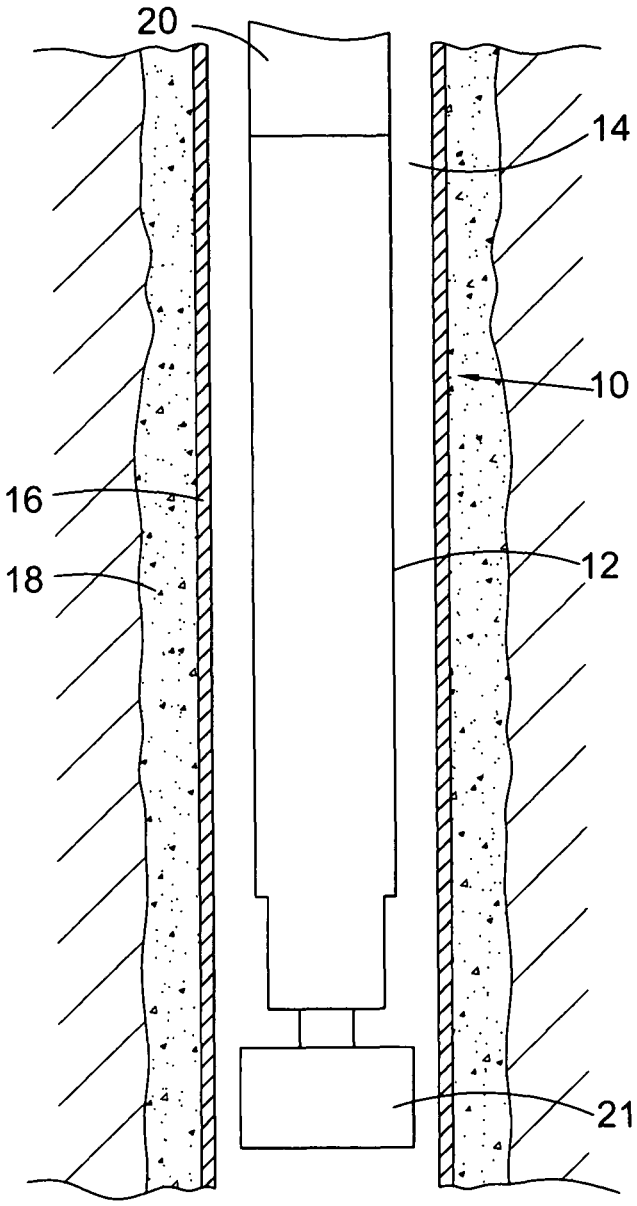
FIG. 1 is a schematic illustration of a downhole tool assembly including a downhole tool in accordance with a first embodiment of the present invention, shown in a downhole environment.

Turning firstly to FIG. 1, there is shown a schematic illustration of a downhole tool assembly, in the form of a drilling assembly indicated generally by reference numeral 10. The drilling assembly 10 includes a downhole tool 12 in accordance with a first embodiment of the present invention, which in FIG. 1 is a downhole tool for generating a rotational drive force, in the form of a turbine. The turbine 12 is located in a borehole 14 which has been lined at 16 and cemented at 18, in a fashion known in the art. The turbine 12 is run into the borehole 14 on coiled tubing 20, and a drill bit 22 is coupled to and driven by the turbine 12. The drilling assembly 10 has particular uses in removing obstructions within the lined borehole 14 and in de-scaling/hydrate removal.

Figure 2A:
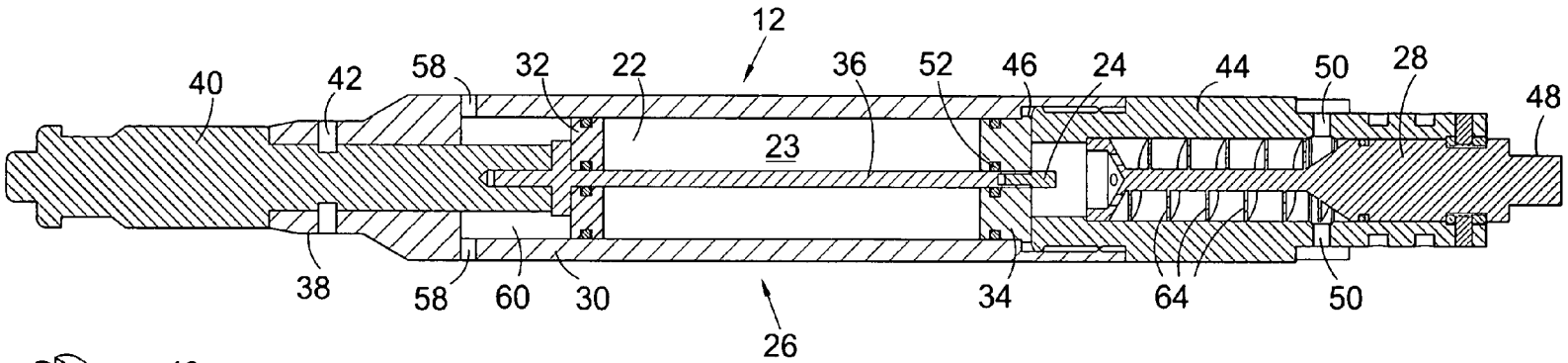
FIGS. 2A and 2B are enlarged, longitudinal sectional and sectioned perspective views, respectively, of the downhole tool of FIG. 1, shown in a run-in-hole (RIH) position.
Figure 2B:
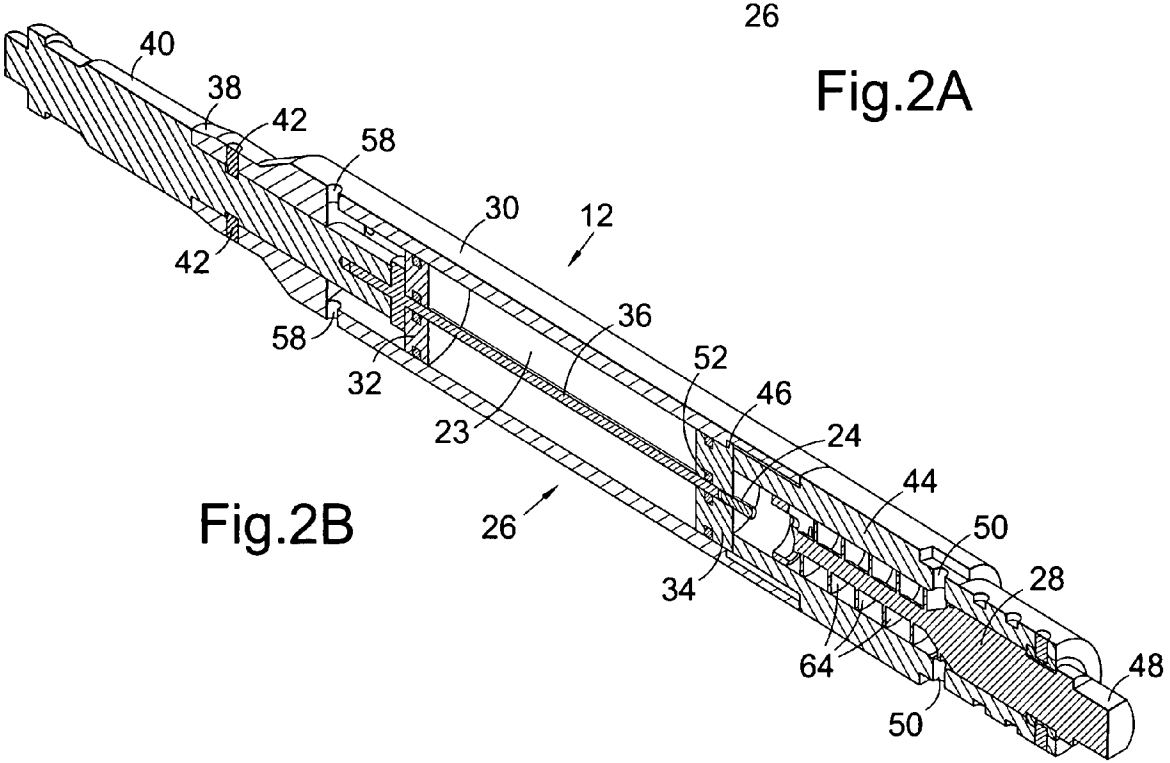

Turning now to FIGS. 2A and 2B, there are shown enlarged longitudinal sectional and sectioned perspective views, respectively, of the turbine 12 of FIG. 1, shown in a RIH position. The turbine 12 generally comprises a chamber 22 for storing a chemical reactant 23, activating means in the form of catalyst means 24 for activating the reactant, isolation means indicated generally by reference numeral 26 and a drive member 28. The isolation means initially isolates the catalyst means 24 from the reactant 23, but also allows the catalyst means 24 to be selectively exposed to the reactant 23. This activates the reactant 23, generating a drive medium for driving the drive member 28, to in-turn generate a drive force.

In more detail, the turbine 12 has an outer body 30 which defines the chamber 22. The isolation means includes a floating piston 32, a fixed seal 34 and a movable member in the form of a support rod 36. The body 30 has a male pin end 38, by which the turbine 12 is coupled to the coiled tubing 20, and a tool connection member 40 extends through the end 38 and is secured to the support rod 36. The tool connection member 40 is initially restrained from movement by shearable release screws 42 which secure it to the outer body 30.

At a lower end of the tool (to the right in FIGS. 2A and 2B), the drive member 28, which takes the form of a turbine rotor, is mounted in a rotor housing 44. A lip 46 of the seal 34 is held between the body 30 and rotor housing 44, to hold the seal 34 in place. The rotor 28 has a lower male pin end 48 for coupling to the drill bit 21. A number of vent ports 50 are spaced around a circumference of the rotor housing 44 (two shown in FIGS. 2A/2B), and these allow venting of spent drive medium from the turbine 12.

The reactant 23 in the chamber 22 is an oxidising agent, in particular hydrogen peroxide ($H_2O_2$), whilst the catalyst means 24 typically takes the form of an iron or copper catalyst, such as iron or copper sulphate. In the RIH position of FIGS. 2A/2B, the catalyst 24 is isolated from the reactant 23 by the fixed seal 34, through which the support rod 36 protrudes, and an O-ring 52 seals the outer surface of the rod 36. The turbine 12 is maintained in this configuration until the drilling assembly 10 has been run into the borehole 14 to the desired location, where it is required to carry out a drilling operation.

Figure 3A:
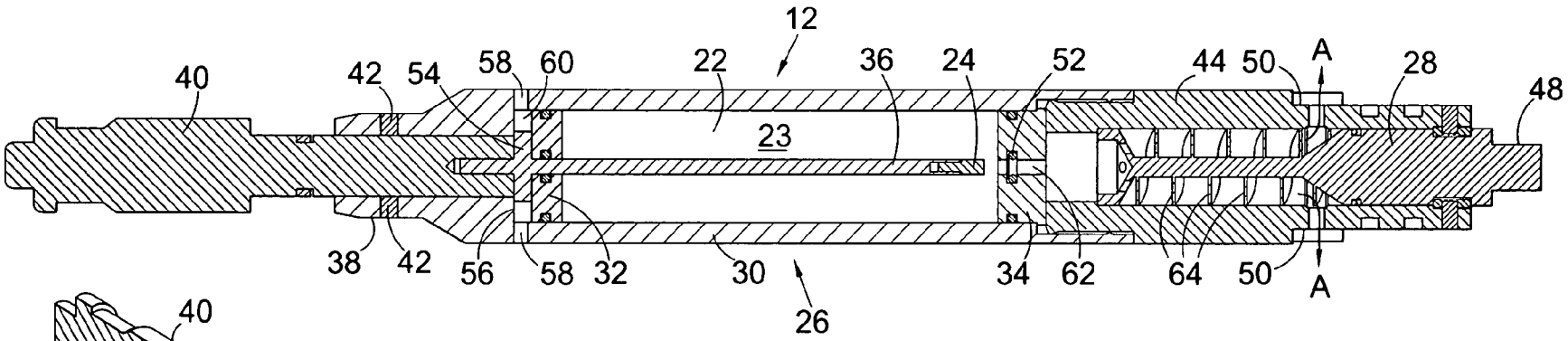
FIGS. 3A and 3B are views similar to FIGS. 2A and 2B, but showing the downhole tool in an in-use position.
Figure 3B:
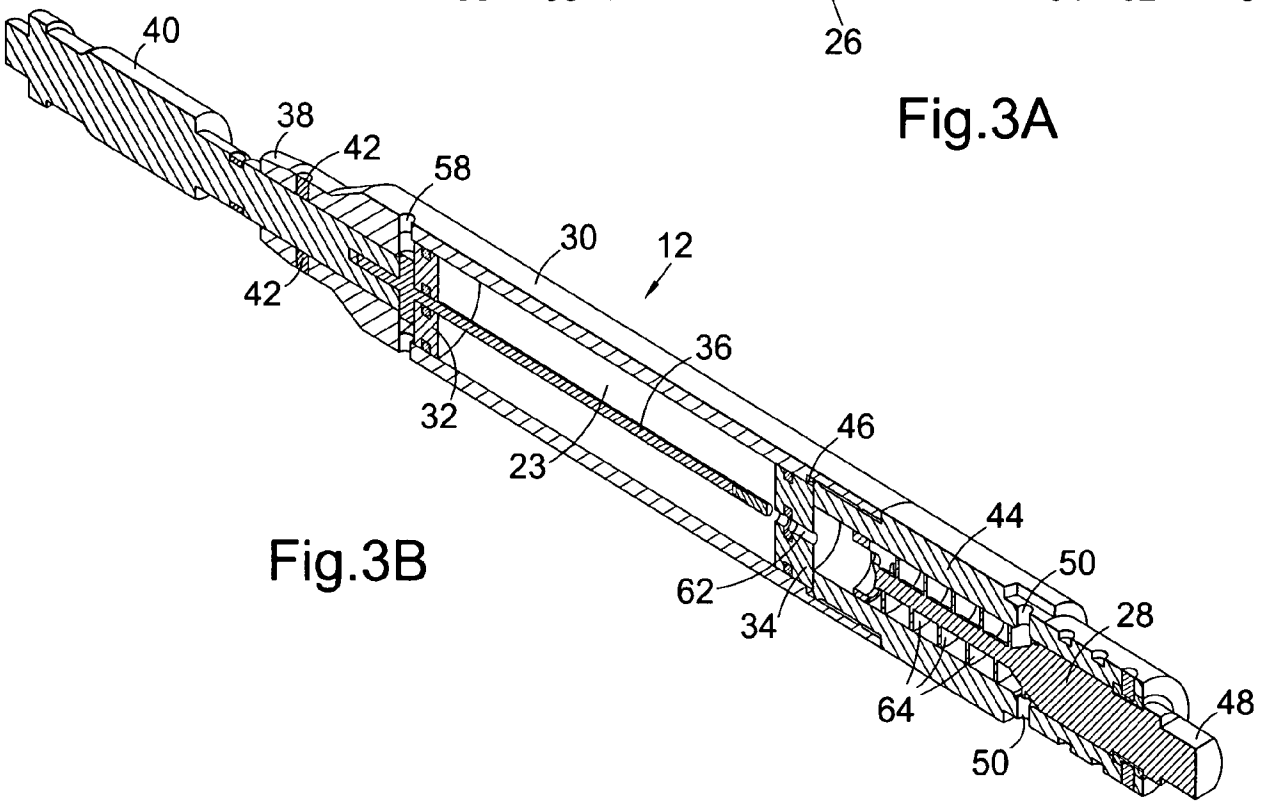

To activate the turbine 12, the tool connection 40 is engaged and pulled to shear the release screws 42, as shown in FIGS. 3A and 3B. This draws the catalyst 24 into the chamber 22, where it is exposed to the $H_2O_2$ reactant 23. A collar 54 on the support rod 36 abuts an end face 56 of the chamber 22, to restrain the rod 36 against further movement. As the support rod 36 moves, the floating seal 32 is carried with it, urged against the collar 54 by the pressure of the generated drive medium. Hydraulic lock of the floating piston 32 is prevented by the provision of bleed ports 58 in the outer body 30, which allow bleed of fluid from the region 60 of the chamber 22 to annulus.

When the catalyst 24 is exposed to the $H_2O_2$, an exothermic reaction takes place and the $H_2O_2$ decomposes into oxygen and steam, constituting the drive medium. The generated drive medium is directed through an outlet passage 62 in the fixed seal 34, which has been opened by movement of the rod 36, and is thus jetted onto the rotor blades 64 of the rotor 28, which is rotated to in-turn drive the drill bit 21. Spent drive fluid discharges through the vent ports 50 to annulus, as indicated by the arrows A in FIG. 3A. When the supply of $H_2O_2$ has been used, the reaction ceases such that no further drive fluid is generated and the rotor 28 stops rotating. Accordingly, the chamber 22 is sized to contain sufficient $H_2O_2$ to carry out the desired drilling operation, as specified above. The downhole tool assembly 10 is then pulled out of hole (POOH) for replenishment of the $H_2O_2$ reactant 23.

Figure 4:
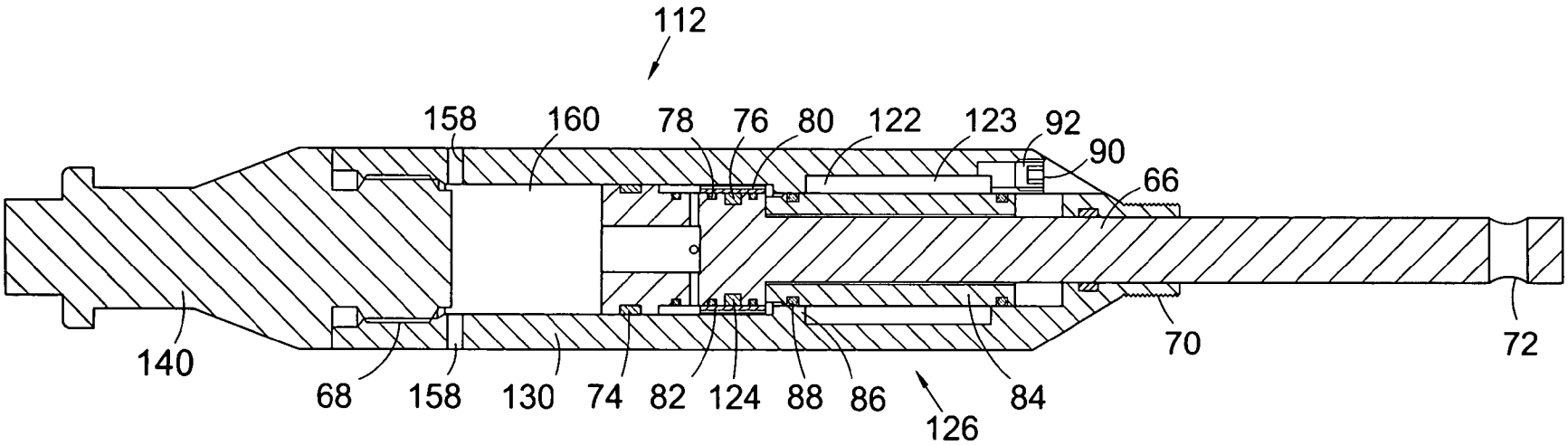
FIG. 4 is a longitudinal sectional view of a downhole tool in accordance with an alternative embodiment of the present invention, and shown in a RIH position.
Figure 5:
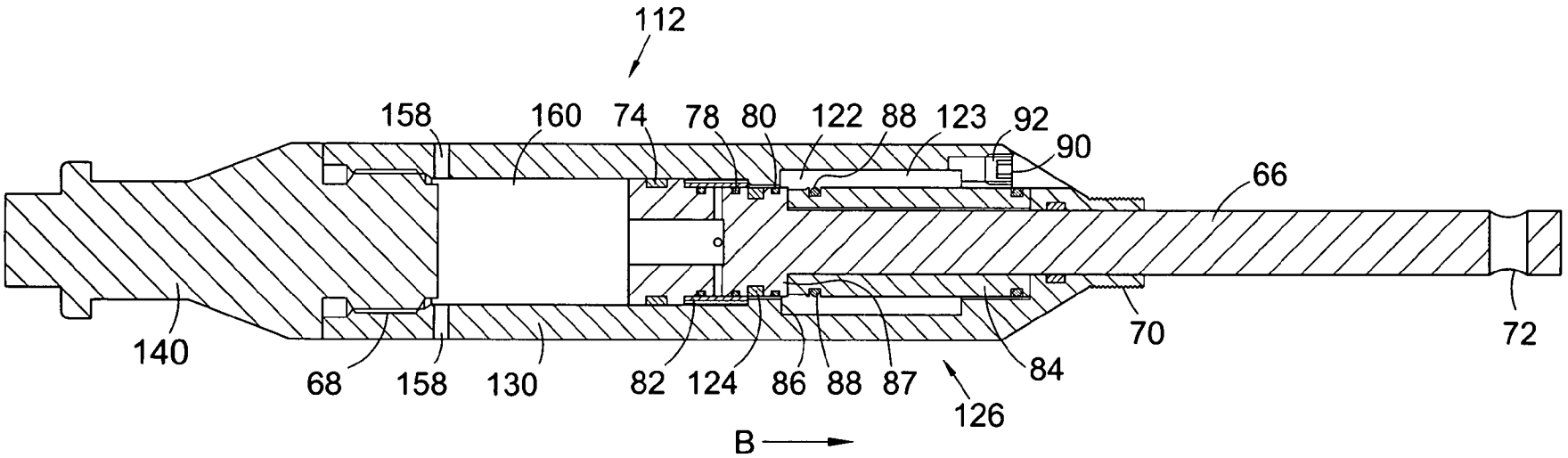
FIG. 5 is a view of the downhole tool of FIG. 4 in an activated position.
Figure 6:
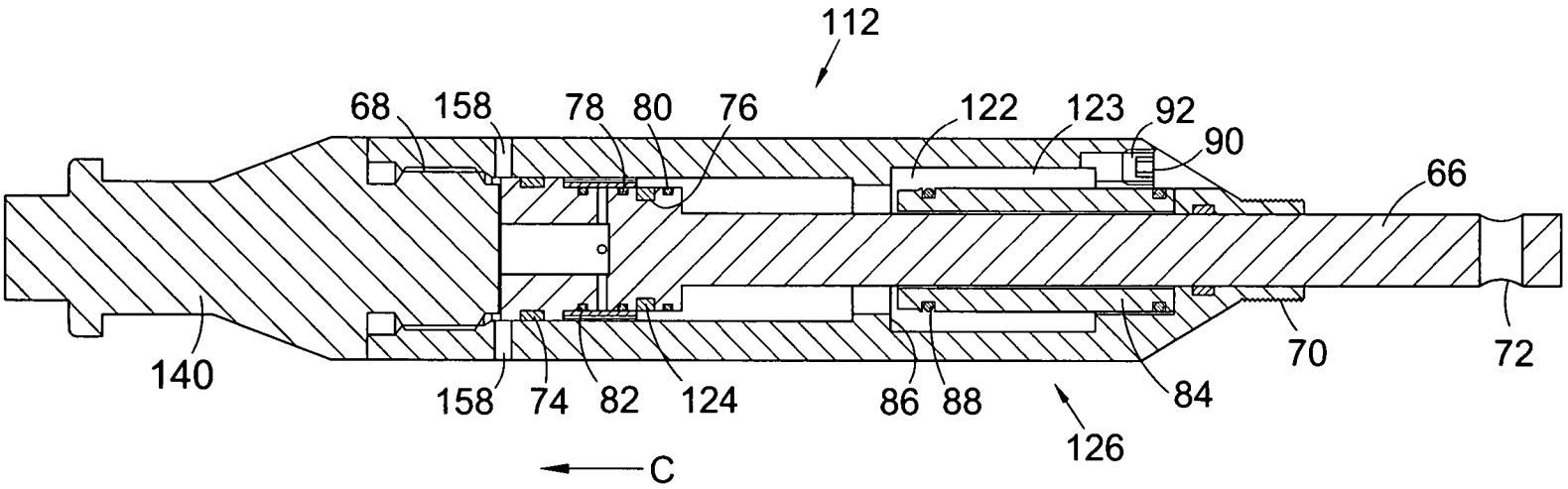
FIG. 6 is a view of the downhole tool of FIG. 4, in a fully stroked position, following activation as shown in FIG. 5.

Turning now to FIGS. 4-6, FIG. 4 shows a longitudinal sectional view of a downhole tool in accordance with an alternative embodiment of the present invention, shown in a RIH position, the tool indicated generally by reference numeral 112. The tool 112 is suitable for generating a force in a downhole environment, in particular an axial force. Like components of the tool 112 with the tool 12 of FIGS. 2A-3B share the same reference numerals, incremented by 100. The setting tool 112 is run on a string of coiled tubing or wireline, in a similar fashion to the turbine 12. The tool 112 takes the form of a setting tool for exerting a setting force on a secondary tool, such as a plug or packer, or for locking gauge hanger anchors or any other downhole tool requiring a relatively high compressive or tensile load to set. The setting tool 112 includes a chamber 122 for storing $H_2O_2$ reactant 123 and a catalyst 124. Isolation means 126 isolates the catalyst 124 from the $H_2O_2$ 123, in a similar fashion to the turbine 12. A piston member 66 is driven by drive medium generated when the catalyst 124 is exposed to the reactant 123, to generate an axially directed force.

In more detail, the setting tool 112 has an outer body 130 and a tool connection 140 coupled to the body 130 by a threaded joint 68. The piston member 66 is movably mounted in the casing 130 and defines a moveable member of the isolation means 126. A lower end (right side in FIG. 4) of the body 130 carries a male threaded coupling 70 for connecting the setting tool 112 to a secondary tool to be set. Similarly, the piston member 66 includes a coupling 72 for coupling the piston 66 to the secondary tool at a second location. As will be described below, this allows a force to be exerted between the two couplings 70 and 72, to exert a tensile (or compressive) setting force upon the secondary tool.

An upper end (left hand side in FIG. 4) of the piston 66 carries a sliding O-ring seal 74 and the body 130 includes a number of circumferentially spaced bleed ports 158, to prevent hydraulic lock of the piston 66. The catalyst 124 comprise a ring located in a groove 76 in the piston 66. O-ring seals 78 and 80 straddle the catalyst 124, sealing against an activation sleeve 82 of the isolation means 126. The isolation means 126 also includes a reactant release sleeve 84 which, in the RIH position of FIG. 4, acts as a primary barrier to isolate the catalyst 124 from the reactant 123, by sealing against a shoulder 86 in the body 130 through an O-ring seal 88. The body 130 also includes a reactant filling port 90 in which a pressure relief valve 92 is mounted. This both allows the reactant 123 to be replenished when the tool is POOH after the downhole procedure has been completed, and allows bleed of reactant 123 and/or generated drive medium in the event of over-pressure during the reaction. The setting tool 112 is secured through the couplings 70 and 72 to the secondary tool to be set.

The reaction is initiated by exerting a pull on the body 130, as shown in FIG. 5. This causes a movement of the piston 66 relative to the casing 130 in a first direction indicated by the arrow B. During this movement, the activation sleeve 82 is restrained against movement with the piston 66 by the shoulder 86, and this uncovers the catalyst 124. In addition, the reactant release sleeve 84 is carried out of sealing engagement with the shoulder 86 by a shoulder 87 of the piston 66, and the catalyst 124 is then fully exposed to the reactant 123, to initiate the reaction.

As shown in the fully activated position of FIG. 6, this causes the piston 66 to move rapidly upwardly in the direction of the arrow C, under the forcing action of the generated drive medium. During this movement, the piston 66 expels fluid from the region 160 in the body 130 through the bleed ports 158. Thus, a high tensile setting force is exerted on the secondary tool as the distance between the first and second couplings 70 and 72 is rapidly shortened. This sets the secondary tool and the setting tool 112 is then disconnected and POOH. The $H_2O_2$ reactant 123 may then be replenished through the filling port 90 for subsequent further use of the setting tool.

Various modifications may be made to the foregoing within the scope of the present invention. For example, the tool 12 has uses in other downhole tool assemblies, such as cutting tools. These cutting tools include milling tools and tubing cutters, where centrifugal blades are fitted to the turbine 12 and are rotated to expand outwards to effect a circular cutting motion, used to cut or profile a wellbore tubular. The turbine 12 may also be used as a setting tool, for setting secondary downhole tools, as an artificial lift tool, or as a linear propulsion tool, fitted to a tractor device for propelling tools, gauges and the like along deviated or horizontal sections of wellbore.

The tool 112 may be used to retrieve tools lodged in a borehole by exerting a high pulling or impact force on the tool. Also, attachments may be provided such as tubing cutters, wireline sidewall cutters, crimpers or the like activated by the axial force generated by the tool.

The downhole tools may thus be used for displacing tools lodged in boreholes, or for the removal of sedimentary deposits or any other obstruction, through associated cutting/impact assemblies.

The invention claimed is:

1. A downhole drive force generating tool comprising:

a reactant chamber;

a catalyst in selective operable communication with the reactant chamber;

an isolator having a physical barrier selectively configurable to facilitate or prevent fluid communication between the reactant chamber and the catalyst.

2. A downhole drive force generating tool as claimed in claim 1 wherein the physical barrier is positioned between the reactant chamber and the catalyst.

3. A downhole drive force generating tool as claimed in claim 2 wherein the isolator is moveable between at least one of a position in which the reactant chamber and the catalyst are segregated from each other and a position in which the reactant chamber and catalyst are exposed to one another.

4. A downhole drive force generating tool as claimed in claim 1 wherein the isolator further includes a seal.

5. A downhole drive force generating tool as claimed in claim 4 wherein the seal is fixed relative to a body of the tool.

6. A downhole drive force generating tool as claimed in claim 1 wherein the isolator includes a movable member.

7. A downhole drive force generating tool as claimed in claim 6 wherein the movable member includes a seal disposed thereon.

8. A downhole drive force generating tool as claimed in claim 1 wherein the reactant chamber includes an outlet passage to direct fluid pressure.

9. A downhole drive force generating tool as claimed in claim 1 wherein the tool further comprises a drive member.

10. A downhole drive force generating tool as claimed in claim 9 wherein the drive member is receptive to fluid pressure from the reactant chamber to do work.

11. A downhole drive force generating tool as claimed in claim 9 wherein the member is a piston.

12. A downhole drive force generating tool as claimed in claim 9 wherein the member is a rotary device.

13. A downhole drive force generating tool as claimed in claim 9 wherein the member is a turbine.

14. A downhole drive force generating tool as claimed in claim 9 wherein the member is a positive displacement motor.

15. A downhole drive force generating tool comprising:

a reactant chamber; and a catalyst movable from a position physically isolated from the reactant chamber to a position in fluidic communication with the reactant chamber.

16. The downhole drive force generating tool of claim 15, wherein the catalyst is positioned within the reactant chamber when in fluidic communication with the reactant chamber.

17. The downhole drive force generating tool of claim 15, wherein the reactant chamber includes a wall having an opening through which the catalyst is movable.

* * * * *